United States Patent [19]

Boutroy

[11] Patent Number: 4,799,435

[45] Date of Patent: Jan. 24, 1989

[54] SECURITY DEVICE FOR TRANSPORTING DOCUMENTS OF VALUE

[76] Inventor: Marc Boutroy, 12 rue Corberie, 60110 Amblainville, France

[21] Appl. No.: 21,767

[22] Filed: Mar. 4, 1987

[30] Foreign Application Priority Data

Mar. 5, 1986 [FR] France ..... 86 03070

[51] Int. Cl.[4] ..... E05G 3/00

[52] U.S. Cl. ..... 109/25; 109/20; 109/32; 109/42

[58] Field of Search ..... 109/20, 25, 29–34, 109/43, 44, 42

[56] References Cited

U.S. PATENT DOCUMENTS

| | | | |
|---|---|---|---|
| 1,892,050 | 12/1932 | Goss | 109/20 |
| 3,344,757 | 10/1967 | Touyet | 109/25 |
| 3,956,997 | 5/1976 | Hall | 109/20 |
| 4,202,279 | 5/1980 | Rand | 109/34 |
| 4,461,222 | 7/1984 | Brunner et al. | 109/20 |
| 4,712,489 | 12/1987 | Levavasseur | 109/25 |
| 4,722,435 | 2/1988 | Mareels et al. | 109/25 |

FOREIGN PATENT DOCUMENTS

| | | |
|---|---|---|
| 2445429 | 7/1980 | France . |
| 2478040 | 9/1981 | France . |
| 2574845 | 6/1986 | France . |
| WO83/02975 | 9/1983 | PCT Int'l Appl. . |
| 1138104 | 12/1968 | United Kingdom . |

*Primary Examiner*—Neill R. Wilson

*Attorney, Agent, or Firm*—Young & Thompson

[57] ABSTRACT

A security device for transporting documents of value such as bank notes, comprising an enclosure having a space for receiving the documents and housing a foam generating unit including a receptacle containing marker liquid adapted to foam up and color documents, said receptacle having openable closure means, a reserve of compressed gas having means for releasing compressed gas, actuating means for controlling said means for releasing compressed gas, at least one movable wall disposed inside said receptacle between said marker liquid and said means for releasing compressed gas, a liquid/air mixing means connected downstream of said receptacle closure means for converting marker liquid into marker foam in response to compressed gas released from said reserve urging said movable wall to force liquid via said closure means to said liquid/air mixing means, and discharge means for carrying marker foam from said liquid/air mixing means to said space for marking said documents.

38 Claims, 10 Drawing Sheets

FIG. 5
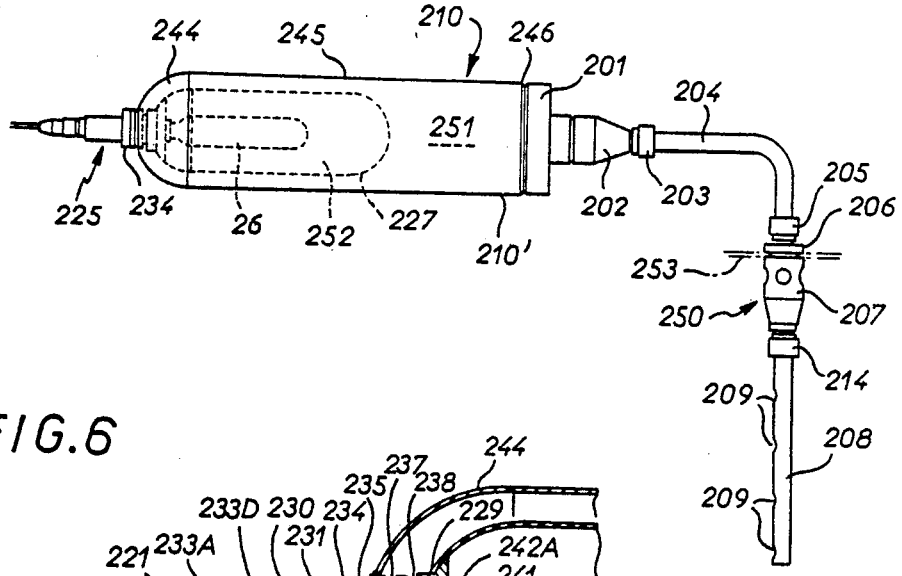
FIG. 6
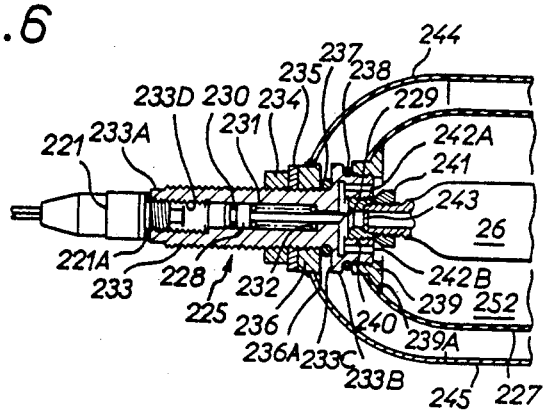
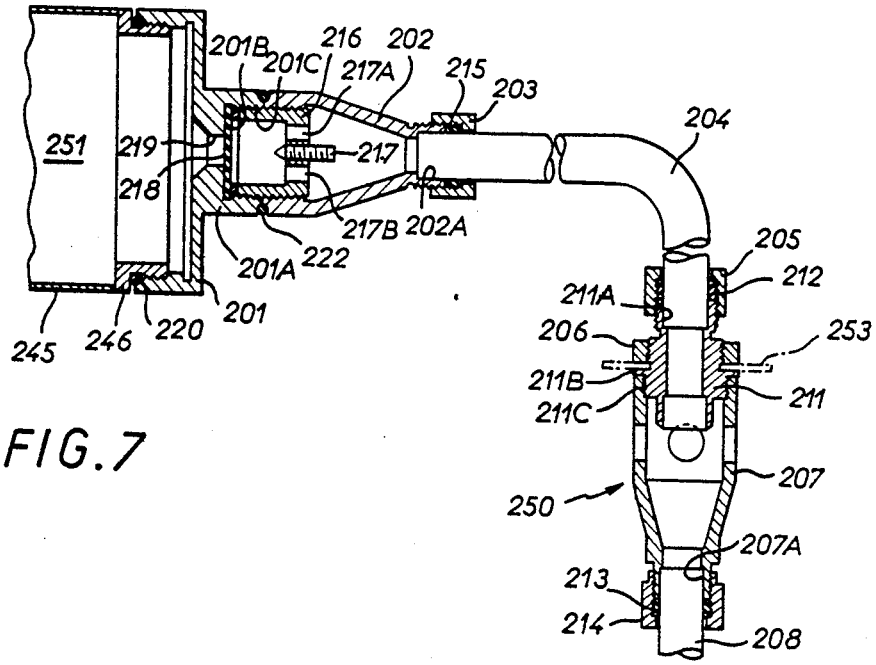
FIG. 7

FIG.14
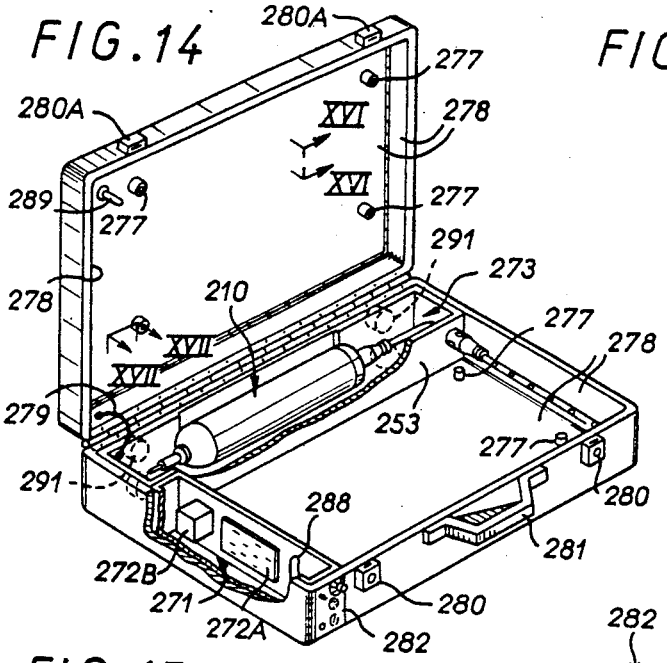
FIG.16
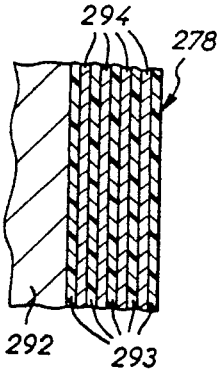
FIG.18
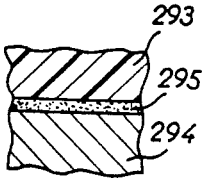
FIG.15a
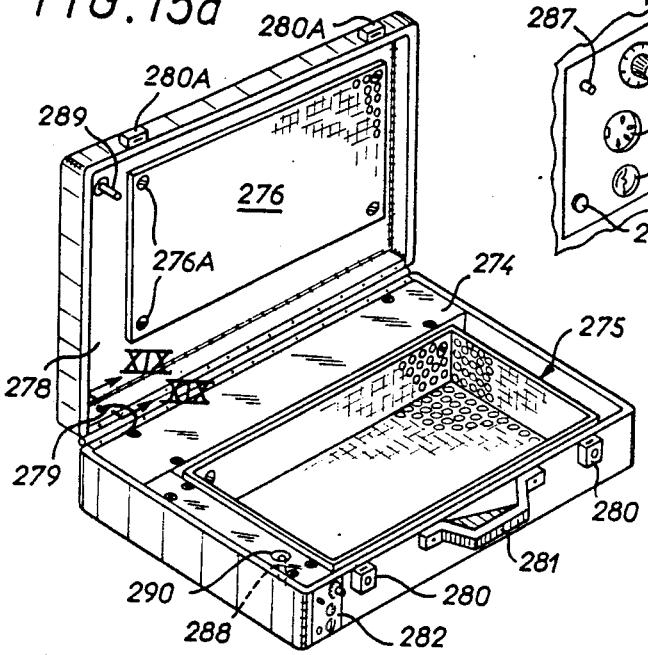
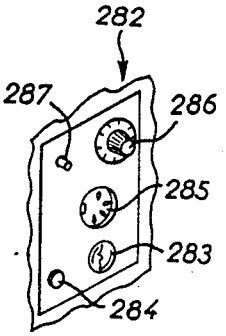
FIG.15b
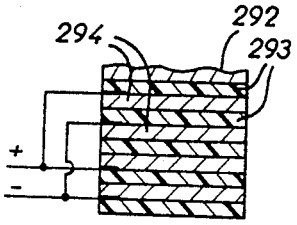
FIG.19
FIG.17
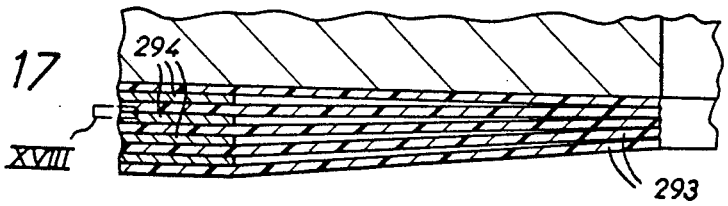

SECURITY DEVICE FOR TRANSPORTING DOCUMENTS OF VALUE

The present invention relates to a security device for carrying documents of value, in particular bank notes, blank identity cards, driving licenses and passports.

When bank notes are involved, such transportation is usually referred to as "currency carrying".

Traditionally, currency or cash is carried in bags placed in armoured vans, the transshipment operations being entrusted to armed carriers.

Despite the precautions taken by currency carriers, many attacks have taken place while cash is being transported.

Whether they succeed or not, such attacks are often deadly and it is desirable to dissuade potential robbers.

The most effective known deterrent is for the documents or paper money transported to be invalidated in the event of an attack.

In known manner, invalidation is carried out by using a liquid dye which produces an indelible marking.

In so far as the dye is approved as an invalidating agent by the national authorities competent in banking matters, the marked notes are reimbursed to their legitimate owner.

In order to mark the documents, one known solution resides in producing flooding with a liquid dye in the event of an attack, within the container used for carrying the documents.

For example, British Pat. No. 1 138 104 describes a container having two superposed compartments. The upper compartment contains a glass vial filled with a liquid dye and adapted to break under the effect of the detonator. The liquid dye released by the explosion flows by gravity into the lower compartment containing the bank notes. This technique does not make it possible to guarantee that the notes will be flooded in all the likely positions of the container.

Patent WO 83/02975 describes a receptacle overhanging a device for injecting liquid dye under the effect of a piston actuated by the explosion of a charge. This injection into the receptacle takes place whatever the spatial orientation of the latter. However, the necessary amount of liquid dye to wet all the notes entails an even greater volume due to the piston-type mechanisms, so that the volume available for transporting notes is small in relation to the total volume of the container. This unfavourable ratio of container volume to volume available for notes is manifest when it is necessary to make large transfers of cash.

Thus, security devices according to the state of the art which provide for direct flooding with a liquide dye do not make it possible to mark a substantial volume of documents. Furthermore, such devices do not ensure a deterrent effect by indelible marking when cash is transferred in cloth bags which are carried by hand from the amour-plated van to a banking or commercial establishment or vice versa, many attacks having been carried out under arms during this phase in the transportation process.

The Applicant has set himself the general task of henceforth ensuring this deterrent by invalidation during all the phases of a conventional type of currency transport situation, to the extent that such transportation may even be modified by the use of commonplace vehicles.

The object of the present invention is a security device which does not have the same drawbacks as in the prior art, which has a low marking capacity and which do not embrace all the phases of currency transportation.

More precisely, the present invention has as its object a security device for transporting documents of value such as bank notes, comprising an enclosure having a space for receiving the documents and housing a foam generating unit including a receptacle containing marker liquid adapted to foam up and color documents, said receptacle having openable closure means, a reserve of compressed gas having means for releasing compressed gas, actuating means for controlling said means for releasing compressed gas, at least one movable wall disposed inside said receptacle between said marker liquid and said means for releasing compressed gas, liquid/air mixing means connected downstream of said receptacle closure means for converting marker liquid into marker foam in response to compressed gas released from said reserve urging said movable wall to force liquid via said closure means to said liquid/air mixing means, and discharge means for carrying marker foam from said liquid/air mixing means to said space for marking said documents.

According to an advantageous embodiment of the invention, the movable wall consists of a deformable diaphragm.

This foam generating unit makes it possible to obtain a considerable volume of foam in relation to a small volume of liquid dye and foaming agent. This volume of foam which may be equal in volume to at least eight times the volume of liquide dye penetrates the closed space containing the documents which are to be marked.

A part of the foam breaks up in contact with the documents and the liquid produced invades the tiniest interstices by capillary action.

Furthermore, the presence of the diaphragm which changes shape under the thrust of the gas prevents mixing of the liquid and gaseous phases inside the generator and thus guarantees operation in any position of this latter.

This foam generating unit constitutes an essential means within the framework of the present invention.

However, it would not by itself make it possible to ensure protection by a deterrent marking of the documents of value during the various phases of their transportation.

As the foam generator is advantageously triggered by an electrical signal, the security device may include a combination of the foam generator with electronic operating means which can be activated and deactivated by an mechanical or electronic key. The electronic operating means when activated will permanently control a series of devices for triggering the foam generator.

The container having an opening/closing 595 km for introducing documents of value in proximity of the outlet orifice of the foam generator according to the present invention, the electronic operating means being deactivated, closure of the container and activation of the electronic control means by the action of a key outside the container ensure automatic operation of the foam generator upon any forbidden manipulation of this container.

Such forbidden manipulation may, without the list being limitative, consist of:

Piercing of the container wall;
Even partial opening of the opening/closing system;
Cooling of the container below a certain temperature;
Heating of the container beyond a certain temperature; and
Introduction of water into the containet;
Non-deactivation by the key provided for the purpose within a time limit provided by a timing device, this time, once it has been determined, being incapable of being cancelled without being previously deactivated;
Diminution of pressure below a certain amount;
Releasing of a carrying handle;
Opening by key of at least one of the mechanical closures of the attache case;
An interruption of an electric circuit between the container and some other object;
Interruption of an electric circuit between the container and a special belt worn by the carrier.

Some of these manipulations will be forbidden by the presence of pick-ups inside the container which likewise has a battery or an accumulator as a source of electric current. Some of these pick-ups are well known in the art and will not be described.

Furthermore, in currency transporting vans, the flooding signal may be triggered by a contact activated by the carrier.

It should be noted that these prohibitions are mutually reinforced so that the scenario relative to carrying the container cannot diverge from a previously determined scenario in terms of either space or time.

The protection against the container partitions being pierced may be provided by a conductive thread enclosed within the sides of the container. Any breakage of this thread will trigger flooding with foam.

In a preferred embodiment, protection against partitions being pierced is provided by a multi-layer protective screen.

The characteristic features and advantages of the present invention will moreover be manifest from the ensuing description which is given by way of example and which refers to the appended drawings, in which:

FIG. 5 is an external view of a second embodiment of the foam generating unit according to the invention;

FIG. 6 is a sectional view of a rear part of the second embodiment of the foam generating unit shown in FIG. 5.;

FIG. 7 is a sectional view of a front part of the second embodiment of the foam generating unit shown in FIG. 5;

FIG. 14 is a perspective view of the second embodiment of a security device which takes the form of an attache case;

FIG. 15 is another perspective view of the second embodiment of a security device according to FIG. 14;

Figure 20:
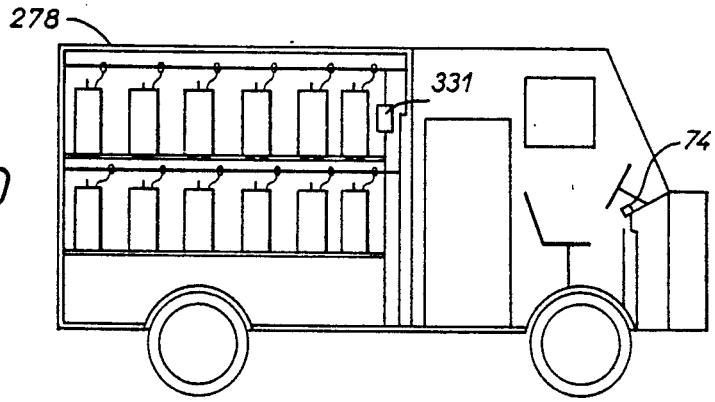
Figure 22:
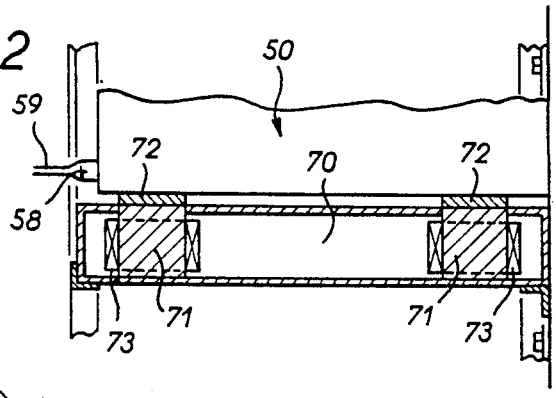
Figure 24:
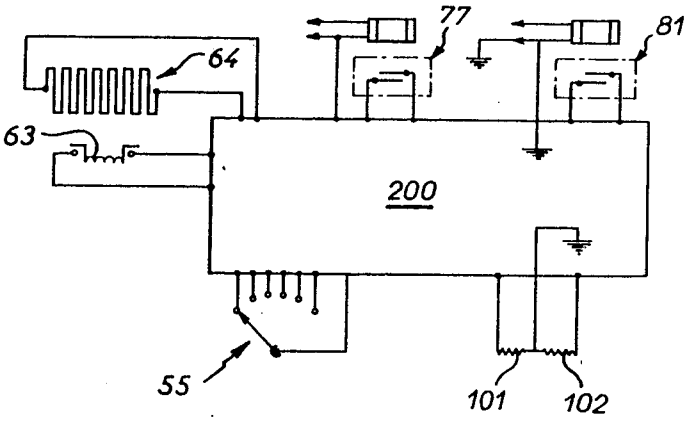
Figure 23:
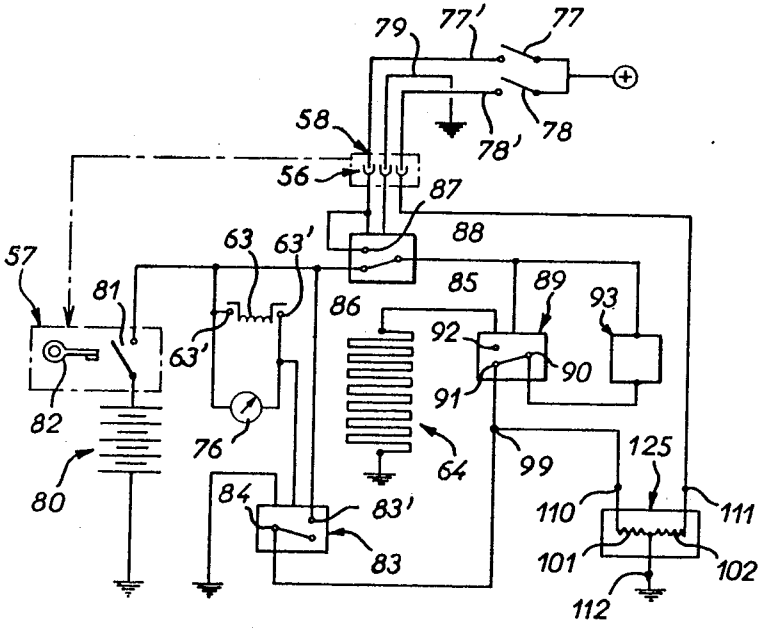
Figure 25:
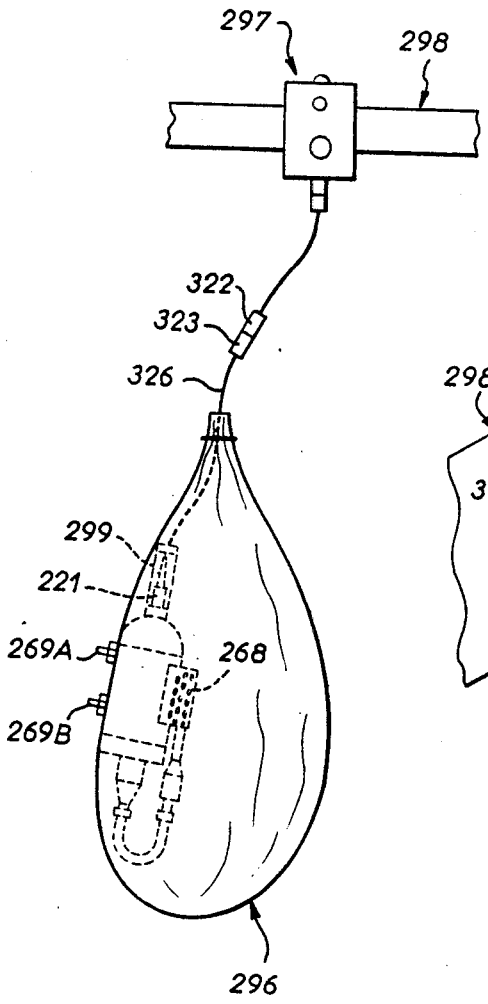
Figure 28:
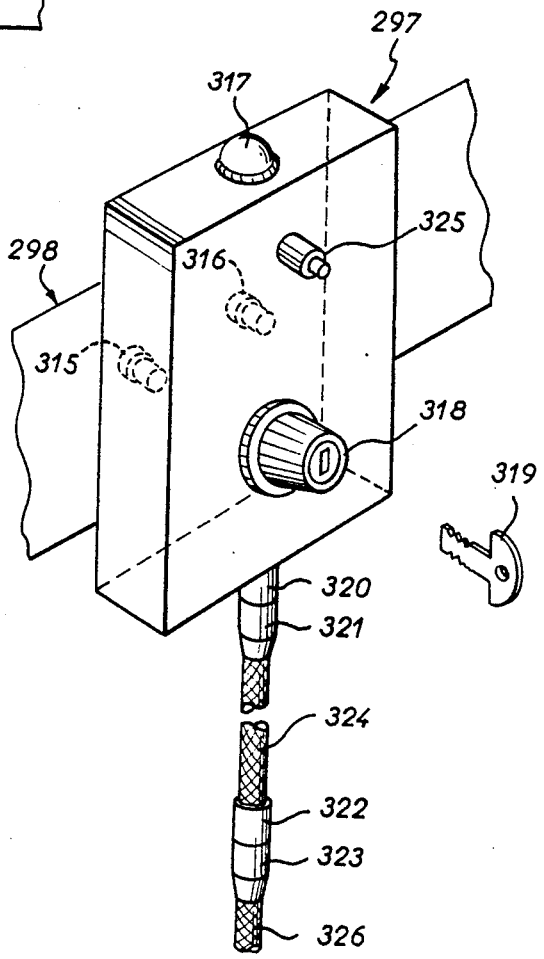
Figure 26:
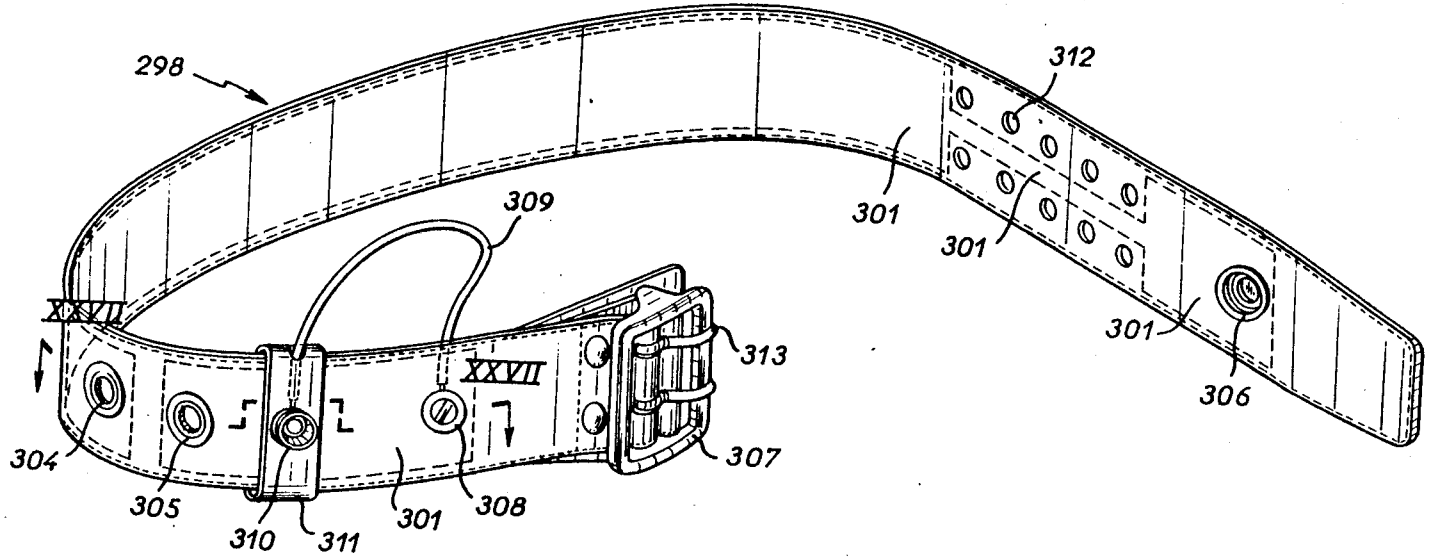
Figure 27:
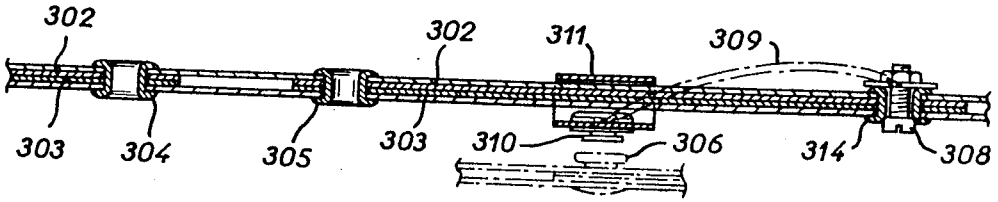
Figure 29:
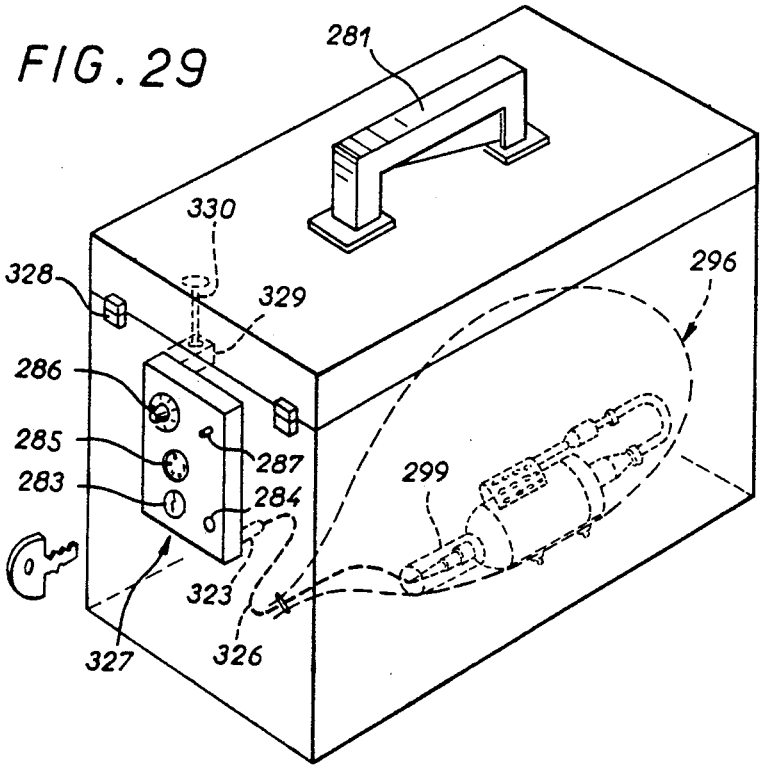
Figure 30:
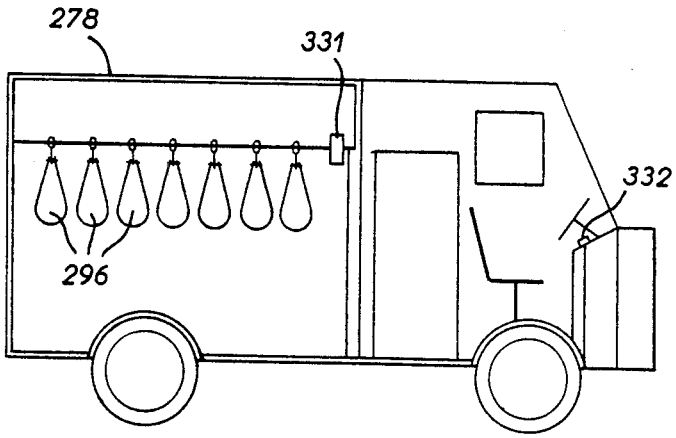

FIG. **15*b* is shows in detail the control box of this attache case as shown in FIG. 15**;

FIG. 16 is a sectional view taken on the line XVI—XVI of the detail in FIG. 14;

FIG. 17 is a sectional view taken on the line XVII—XVII of the detail shown in FIG. 14;

FIG. 18 is an enlarged view of the detail from FIG. 16, identified on this latter by the inset XVIII;

FIG. 19 is a diagrammatic view of a section taken on the line XIX—XIX of a detail in FIG. 15;

FIG. 20 is a diagrammatic view of a third embodiment of a security device according to the invention and employing the first embodiment of a security device according to the invention;

FIG. 24 is a partial perspective view of the third form of embodiment of a security device according to the invention;

FIG. 22 is a sectional view taken on the line XXII—XXII of a detail of execution of the third embodiment of a security device according to the invention;

FIG. 23 is a diagram of an electric circuit employed in the first form of embodiment of a security device according to the invention;

FIG. 24 is a diagrammatic view of an alternative embodiment of the first type of security device according to the invention;

FIG. 25 is an overall view of a third embodiment of a security device according to the invention and employing the fourth embodiment of the foam generating unit according to the invention;

FIG. 26 shows in detail a part of FIG. 25;

FIG. 27 shows a section taken on the line XXVII—XXVII in FIG. 26;

FIG. 28 is an enlargement of the detail in FIG. 25;

FIG. 29 is an overall view of a fifth embodiment of a security device according to the invention and employing a part of the security device in its fourth embodiment;

FIG. 30 is an overall diagrammatic view of a sixth embodiment of a security device according to the invention and employing a part of the security device from the fourth embodiment.

Figure 1:
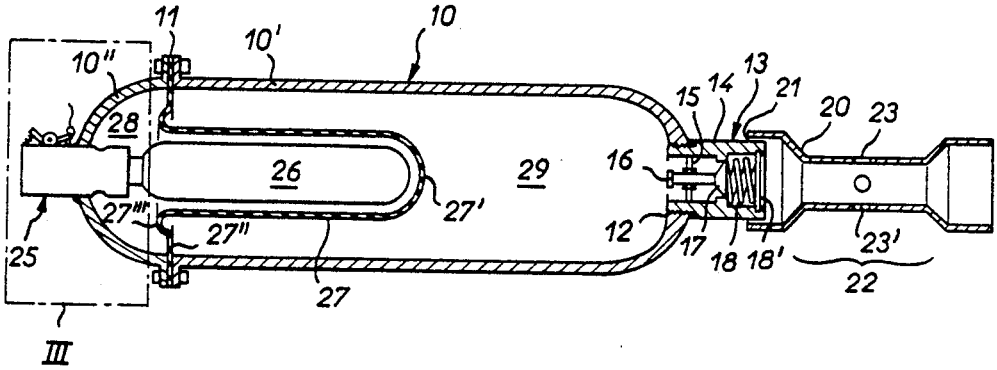
FIG. 1 is a sectional view of a first embodiment of the foam generating unit according to the invention.

FIG. 1 illustrates a first embodiment of a foam generator according to the invention, comprising an accumulator 10 generally in a cylindrical form, each of its two longitudinal ends terminating in a hemisphere.

The accumulator 10 is in two parts, a main part 10' constituted by the cylinder and hemispherical end, and a hemispherical cup 10'' which is fixed to the main part 10' by a seal 11 disposed at a right angle to the axis through the cylinder and constituted by a lip projecting radially from the main part 10' and from the cup 10''.

Conventional screwing means are provided to connect these two lips.

Opposite the cup 10", the hemispherical end of the main part 10' comprises a screw-threaded opening 12, in which a valve 13 is screwed.

The valve 13 as a whole comprises an exhaust member 14 which is substantially cylindrical, containing a star-shaped support guide 15 for axially guiding a valve stem 16 which terminates in an obturator 17, of which a so-called dorsal face has a partially frustoconical form in order to co-operate in fluidtight manner with a radial inner projection on the discharge body 14 which is of a matching shape.

A helical spring 18 bearing on a step 18' is housed in a part of the discharge body 14 situated downstream of the obturator 17. The spring 18 tends to close the valve, exerting an axial force on a so-called leading face (in fact, facing towards the outside of the accumulator) of the obturator 17.

Any axial force which is exerted on the back of the obturator 17 tends to detach the latter from the discharge body 14 and move it outwardly, and to compress the spring 18 whilst so doing.

A so-called discharge nozzle 20 is fixed on the projecting end of the valve 13 while providing an annular air intake 21 by virtue of its inner diameter being greater than the outside diameter of the valve 13.

The discharge nozzle comprises a bottle neck 22 provided with four transverse air intakes 23 (of which only three can be seen in the drawing) in its smallest diameter portion.

Downstream of the bottle neck 22, the discharge nozzle 20 resumes its initial diameter.

The cup 10" comprises at its apex a partially projecting piercing member 25 extending in part within the cup.

The piercing member 25 is extended in the form of a pressurised liquid gas cylinder 26 extending overall in an axial direction and inside the accumulator. A sac 27 of deformable material fits on one side against the seal 11 gripped between the radially projecting lips of the accumulator 10, and on the other against the bottle 26 like a glove finger 27'.

In practice, a crown-shaped flat part 27" of the sac 27 is connected to the part 27' which forms a glove finger through a semi-toroidal corrugation 27'''.

The sac 27 insulates in fluid-tight manner a so-called pressure face 28 confined by the cup and the sac containing the internal parts of the piercing member 25 and the bottle 26 of a space 29 constituted by the remaining interior volume of the accumulator 10.

Figure 2:
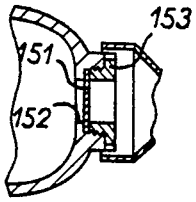
FIG. 2 is a detailed view of an alternative embodiment of the first type of foam generating unit according to FIG. 1.

FIG. 2 shows an alternative embodiment which employs a simple cover 151 disposed against and in such a way as to occlude a nozzle 152 constituting the mouth of the accumulator 10.

The cover 151 is clamped against the nozzle 152 by an annular clamping member 153 having a cylindrical inner recess which is substantially the same diameter as the nozzle 152, comprising an external screwthread and a radial projection by which it can be screwed onto a matching screwthread provided to project from the accumulator 10. The cover 151 is designed to break when one of its faces is subjected to a pressure exceeding a given threshold.

Figure 3:
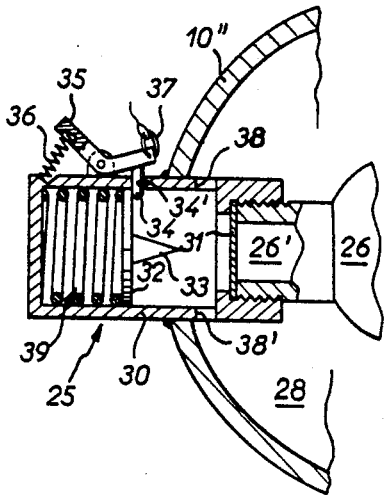
FIG. 3 is a sectional view of a detail in FIG. 1, marked on the latter by the insert III.

FIG. 3 shows the piercing member 25 in greater detail. In this first embodiment, the piercing member is mechanical.

Such a piercing member 25 comprises a cylindrical body 30 occluded at its end projecting from the cup 10" which it traverses via a nozzle exactly matching its cross-section and to which it is welded and completed at its opposite end by an inner screwthread.

The bottle 26 is fixed to the piercing member 25 by a matching screwthread permitting it to be screwed into position.

The neck 26' of the bottle 26 is occluded by a cover 31. The gas contained in the bottle 26 is released when this cover is broken.

A movable disc 32 provided with a point 33 projecting axially in the direction of the cover 31 is retained by a pin 34 projecting transversely towards the interior of the body 30 of the piercing member, sliding within a nozzle 34' provided in this latter at an axial level outside the cup 10".

In the position shown, the movable disc 32 is compressing a helical spring 39 bearing on the bottom of the piercing member 25. The pin 34 is rigid with an L-shaped lever 35 outside the piercing member and adapted for movement about an axis, provided the spring 36 seeking to move one arm of the lever away from the body 30 of the piercing member, which tends to cause the pin 34 to penetrate the nozzle 34'.

The other arm of the lever 35, rigid with the pin 34, comprises a traction ring 37 which makes it possible to pull the pin 34 out of the nozzle 34', releasing the disc 32 and therefore the spring 39. A string is attached to the traction ring 37.

The body 30 of the piercing member comprises two nozzles 38, 38', situated inside the cup 10", adapted to connect the bottle 26 to the pressure space 28 when the cover 31 is opened.

The device according to the first embodiment of the invention described and illustrated in FIGS. 1 and 2 constitutes a foam generator intended to be disposed within a container, for example a bag for transporting documents of value.

One use of the device described consists in placing it in a bag intended for carrying money, that is to say which contains paper money.

The accumulator 10 is filled with a liquid confined in the space 29 said, liquid being adapted to colour and foam up when. Such a liquid advantageously contains Rhodamine-base according to the following formula:

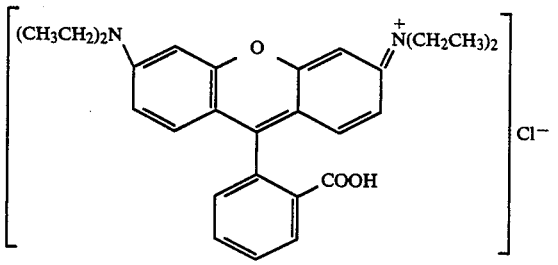

Rhodamine-base is an indelible colouring agent capable of marking bank notes which, when they are so marked, become useless.

Such notes, if they are returned by their lawful owner, will be reimbursed by the issuing bank.

Other dyes may be used without the following list, which is given by way of example, being in any way limitative:

Tartrazine to the following formula:

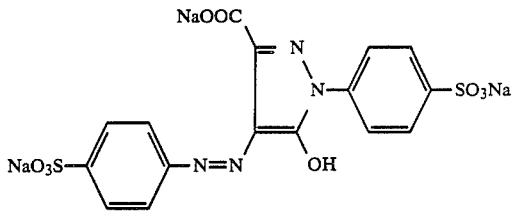

"Patent Blue V" to the formula:

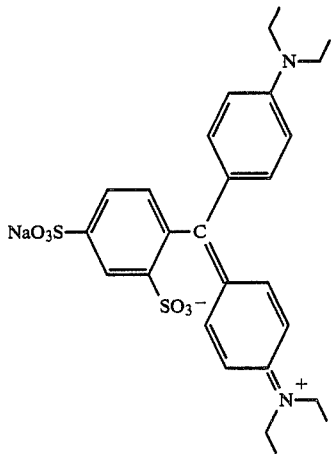

"Brilliant Blue FCF" to the following formula:

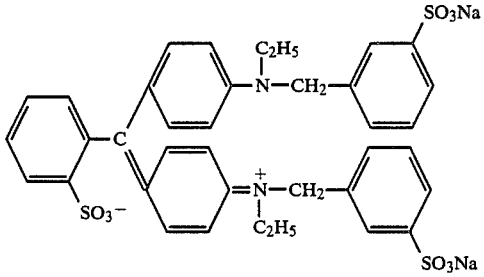

The above mentioned dyes are capable of being used by themselves or in mixtures.

The choice of dye may vary from one country to another according to whatever approval is obtained from the central banks in question.

A particular suitable dosage consists of an aqueous mixture comprising about 0.125% to 0.3% by volume dye.

The aqueous mixture according to the invention likewise comprises a surfactant.

Advantageously, this is an alkaline lauryl ether sulphate, for example of ammonium, sodium or potassium.

Advantageously, the proportion of surfactant in the aqueous mixture is 3% approx. by volume.

The aqueous mixture may possibly comprise an antifreeze agent, in particular ethylene glycol or propylene glycol.

A foam generator according to the invention, filled with liquid dye and foaming agent is for example disposed inside a bag containing the notes.

A string attached to the ring 37 emerges from the bag and the carrier attaches it for example to his wrist.

In the event of the bag being stolen, there will necessarily be tension on the string at a given moment.

The ring 37 is thus pulled, which pulls the pin 34 out of the body 30 of the piercing member through the nozzle 34'. The movable disc 32 is thus released, the spring 39 expands and pushes it towards the cover 31 which the point 33 strikes and breaks.

This releases the gas which is contained under pressure in the bottle 26.

Advantageously, the gas is carbonic acid gas.

Released into the space 28, the gas inflates the sac 27 the effect of this being to pressurise the space 29 and therefore the marker liquid. As the pressure of this latter increases, the obturator 17 tends to become detached from the discharge body 14, when the pressure rises above a certain threshold.

The marker liquid then escapes through the discharge nozzle 20.

The combined action of the air intake 21 of the venturi formed by the spout 22 and 23 with the surfactant contained in the liquid causes a colouring foam to form.

By capillary action due to the surfactant, the foam has a much higher wetting power than a liquid which has no surfactant, which enables it to penetrate into the closely packed bundles of notes.

Furthermore, the formation of foam considerably increases the space occupied by the marker liquid.

After release of the carbonic acid gas, approximately 24 liters of foam emerge from the discharge nozzle for three liters of marker liquid initially contained in the accumulator.

The interior space of the container in which the notes or documents are accommodated is flooded far more completely with a foam produced by a device according to the invention than with a liquid which flows out in a conventional manner.

Figure 4:
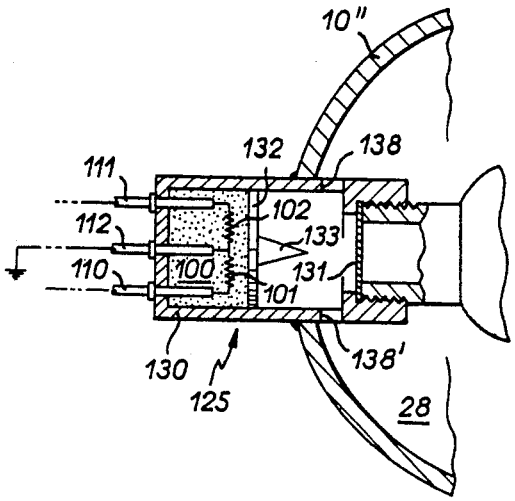
FIG. 4 is a sectional view of a part of the invention equivalent to that shown in FIG. 3 and in accordance with variant.

FIG. 4 illustrates a piercing member according to a second embodiment.

This is a piercing member of a pyrotechnic type. Such a piercing member 125 is of a structure which closely resembles that of the previously described piercing member 25.

There is once again a movable disc 132 extending transversely inside the body 130 provided with a point 133 which projects axially towards a cover 131 closing the bottle of liquid gas.

This latter is fixed by being screwed into the piercing member 125.

Two holes 138 and 138' are adapted to produce communication between the bottle of liquid gas and the pressure space 28 when the cover 131 is pierced.

At rest, the disc 132 confines a space 100 bounded likewise by the bottom of the piercing member 125. The space 100 is filled with a detonating material, for example blasting powder.

Three conductors 110, 111, and 112 pass in fluid tight manner through the bottom of the body 130 of the piercing member and connect two resistors 101 and 102 in the following way:

Resistor 101 is connected to conductors 110 and 112.

Resistor 102 is connected to conductors 111 and 112.

The conductor 112 is connected to an electrical earth.

When one or other resistor is connected to a voltage, this produces ignition of the powder which, as it detonates, pushes the disc 132 which causes the point 133 to pierce the cover 131.

In practice, an application of a voltage to one of the conductors 110 or 111 fires the piercing member which, as previously described, triggers flooding.

FIG. 5 shows an overall view of the preferred embodiment of foam generator for use in a security attache case which is described hereinafter with reference to FIGS. 14 and 15.

This foam generator comprises an accumulator 210 of cylindrical form which at one end, referred to as the rear part, terminates in a hemisphere 244 while the other end, the so-called front part, has a cover 201.

The accumulator is in two parts, a first part 210' consisting of a cylinder 245 bounded by two flat surfaces to which are respectively welded a hemispherical cup 244, a screwthreaded connecting member 246, and a second part consisting of a cover 201 which is screwed on to the connecting member 246. The pyrotechnic piercing member 225 is fixed to the hemispherical end 244.

This will be described hereinafter in greater detail and with reference to FIG. 6.

To the end of the accumulator which is constituted by the cover 201 is fixed the system 202 for occluding or channelling the marker liquid, connected by a right-angled duct 204 to a foam generating unit 250 which will be described in detail hereinafter with reference to FIG. 7.

The foam generating unit 250 is connected to a foam discharge tube 208 provided with apertures 209 directed towards the concavity defined by the accumulator and the angled duct 204.

The accumulator 210 contains the deformable diaphragm in the form of a sac 227 which takes the general form of a sausage.

The compressed gas bottle 26 is generally situated inside this sac which defines a so-called pressure space 252 and a space 251 containing the liquid adapted to foam up and act as a dye.

FIG. 6 represents in detail and in section the so-called rear part of the foam generator shown in FIG. 5.

The hemisphere 244 in the accumulator 210 comprises a circular initial opening having substantially the same axis as the axis of the cylinder 245. Fixed in this opening my fluid tight welding is a circular nut 236 on which there is a shoulder **236*a* inside the cylinder 245, extending radially slightly beyond the initial circular opening. Into the screwthread on this nut 236 there is screwed, passing through the interior of the cylinder 245, a long rod 233 which has a head 233*b* of larger diameter than that of the rod and of which the shoulder 233*c* flattens sealing-type O-ring packing 237. To facilitate the various screwing operations, the rod 233 has at its end opposite the head 223*b* two flat surfaces 233*a*. Fixing of the rod 233 to the nut 236 is reinforced by the nut 235 and the counter nut 234**.

The rod 233 is hollow along its axis. From the end carrying the two flaps **233*a*, this rod has an axially orientated inner screwthread into which is screwed an igniter 221 marketed by DAVEY-BICKFORD, a fluid tight seal being ensured by a clamping packing 221*a*. This screwthread 233*d* is followed by a cylindrical bore in which a piston 228 can slide, being fitted with a rectilinear spindle ending in a chamfered tip 229. This piston 228 has a groove 230 provided with a fluid tight O-ring. The spindle is enclosed by a spring which abuts a face of the piston and the bottom 232** of the said bore which is followed by a second bore of a diameter slightly larger than that of the spindle and which can serve as a guide while the spindle is sliding.

The chamfered tip 229 fits flush in the recess in the head **233*b* which has an internal screwthread 240 which communicates with two axially symmetrical bores 242*a*, 242*b*. An adaptor 241 screwed into this screwthread 240 allows a bottle 26 of liquid carbonic acid gas marketed by Messrs. Roth to be screwed into position. This bottle comprises a cap 243 adapted to be pierced by the forward movement of the tip 229. As it passes through the interior of the cylinder 245 and above the bottle 26, the sac 227 becomes fixed in fluid tight fashion by means of a metal head 239 which is screwed onto the male screwthread of the head 233*b*, flatening the O-ring seal 238**.

This combination of sac 227 and metallic head 239 is assembled as follows: the shoulder **239*a* has a spherical curvature and is sand blasted or shot blasted to produce roughness to which the synthetic rubber which forms the sac 227 can adhere during cold moulding and under a pressure of six bars. The rubber is then hardened by being stoved at 170° C. for two hours to produce a rubber with a shore hardness of 40**.

FIG. 7 shows in detail and in section the so-called "front" part of the foam generator shown in FIG. 5.

The cover 201 is screwed on to the screwthread of the junction piece 246, flattening a sealing tight O-ring 220. This cover is provided with a hollow neck **201*a* in which there is a nozzle 219 which communicates with a countersink 201*b* in which there is a rubber plug 218 which forms a tight seal and frangible packing. This countersink is followed in an axial direction by a screwthread 201*c* into which is screwed a small hollow cylinder 216 provided with two nozzles 217*a* and 217*b* and a pointed screw 217 and which squeezes against the rubber plug 218. Screwed onto the remaining portion of screwthread on the cylinder 216 is a hollow cap 202 of generally frustoconical shape, which presses on the O-ring seal 222. A pipe 204 has one of its ends fitted in rigid and sealing tight fashion into the terminal countersunk hole 202*a* of the cap, by means of a compression-gland type of clamping device, through a cap nut 203 enclosing a seal 215. The other end of the pipe which has been bent to a right angle fits into the stepped recess 211*a* in a injector 211, via a compression-gland type of fitting having a cap nut 205 enclosing a seal 212**.

The injector 211 passes through a plate 253 forming a partition in the attache case which will be described hereinafter. A nut 206 makes it possible to secure the injector to the plate 253.

This injector discharges into a venturi tube 207 screwed on to the screwthread **211*c* of the injector. The venturi tube is provided with four air intake holes and is extended by the foam discharge tube 208. The tube 208 also fits into the stepped recess 207*a* via a compression-gland type of fitting having a cap nut 214 enclosing a packing 213**.

Figure 8:
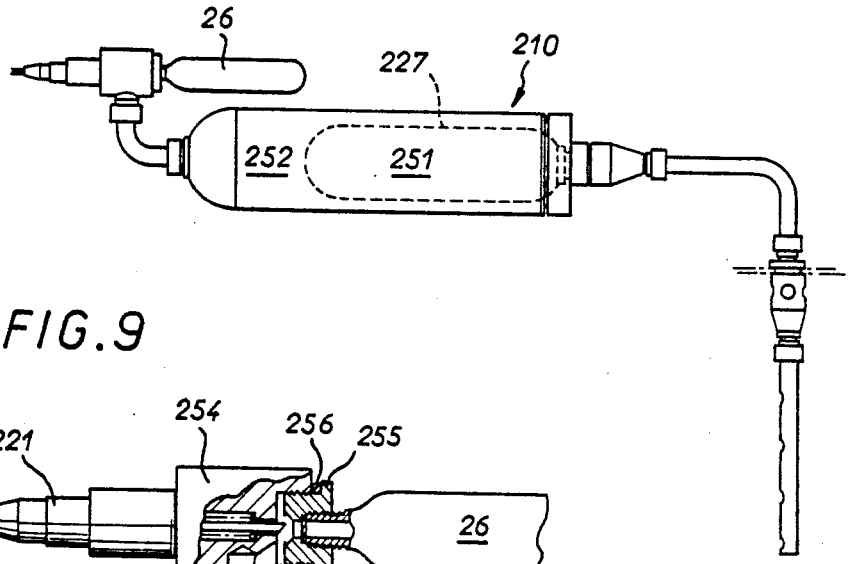
FIG. 8 is an external view of a third embodiment of the foam generating unit.

FIG. 8 generally represents a third embodiment of the foam generating apparatus according to the invention.

This embodiment provides an inverted division in the space inside the accumulator 210 in relation to the previous embodiment. Indeed, here it is the sac 327 which contains the colouring and foaming liquid while the so-called pressure space 252 is in the accumulator outside the sack. Furthermore, in this case the bottle 26 is outside the accumulator 210.

Figure 9:
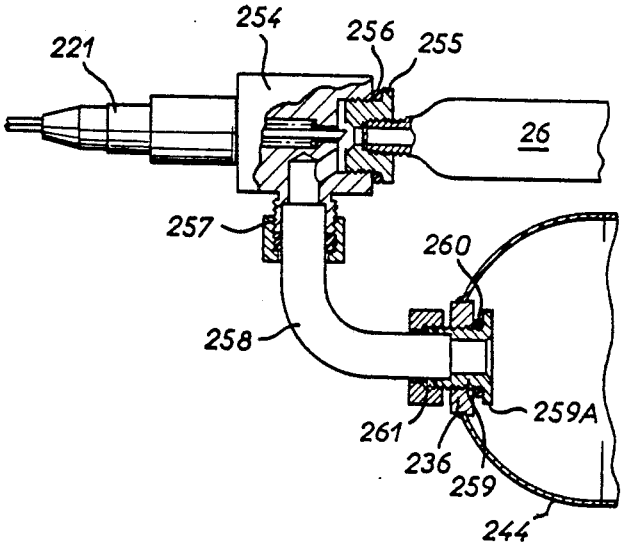
FIG. 9 is a sectional view of a rear part of the third embodiment of the foam generating unit shown in FIG. 8.

FIG. 9 shows the detail of the so-called "rear" part of the foam generator in FIG. 8. Here, the same first part 210' of the accumulator 245 as was described with reference to FIG. 5 is used. The (DAVEY-BICKFORD) igniter 221 is screwed in sealing tight fashion to a junction containing the same system of perforations as described with reference to FIG. 6. Here the adaptor 255 presses against an O-ring seal 256 and the gas outlet nozzles discharge in a screwthreaded cylindrical outlet 257 the axis of which is substantially perpendicular to the axis of the igniter 221 and of the bottle 26. Connected to this outlet 257 is a pipe 258 bent to a right angle, via the same compression-gland arrangement as that described with reference to FIG. 7. This pipe 258 is connected to the interior of the accumulator by fitting into a union 259 of which a shoulder 259*a* presses on an O-ring seal 26. A cap nut is screwed onto the screwthread of the fitting 259 and encloses a compression packing 261.

Figure 10:
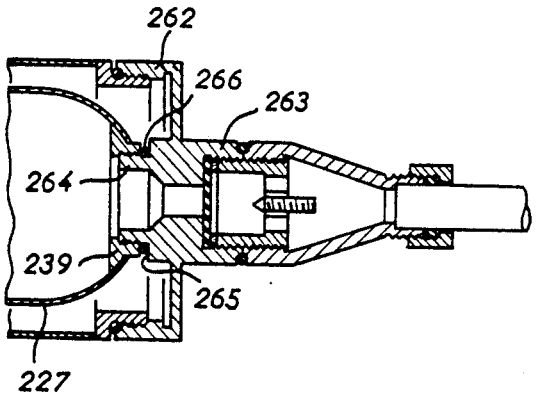
FIG. 10 is a sectional view of a front part of the third embodiment of the foam generating unit shown in FIG. 8.

FIG. 10 shows a detail of the so-called "front" part of the foam generator shown in FIG. 8. Here only the cover structure 262 is slightly modified in relation to that of the cover 201 shown in FIG. 7. The hollow neck 263 is extended on the inside by a projection 264, partly screwthreaded and having a shoulder 265. Screwed on to this threaded projection 264 is the metal head 239 of the sac 227, which flattens an O-ring seal 266.

Figure 11:
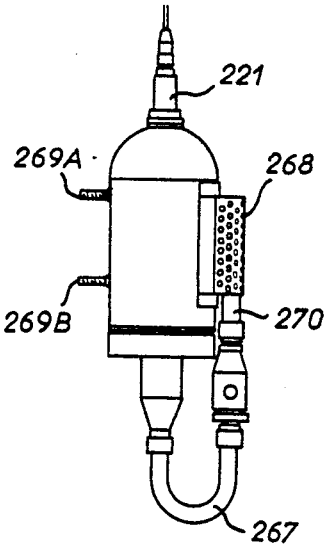
FIG. 11 is an external view of a fourth embodiment of the foam generating unit.

FIG. 11 shows a general view of the preferred embodiment of foam generator intended for use in cash carrying bags which constitute the fourth embodiment of the safety device.

The interior structure of this foam generator is similar to that in FIG. 5. However, the accumulator is shorter which means that the gas expansion sac can be smaller. The outlet tube 267 is bent to a U-shape so that the foam discharge tube 270 is situated in the space created by a foam distributing grid 268, between this grid which is arranged in a U-shape, and the outer wall of the cylinder of the accumulator where it is fixed. On the cylinder of the accumulator, approximately in the median plane of the U-shaped grid and of the discharge tube passing through the axis of the said cylinder, opposite, there are welded two screws 269*a*, 269*b* which extend radially towards the exterior, substantially in this median plane. These screws are intended for fixing the foam generator to the wall of a carrier sack.

Figure 13:
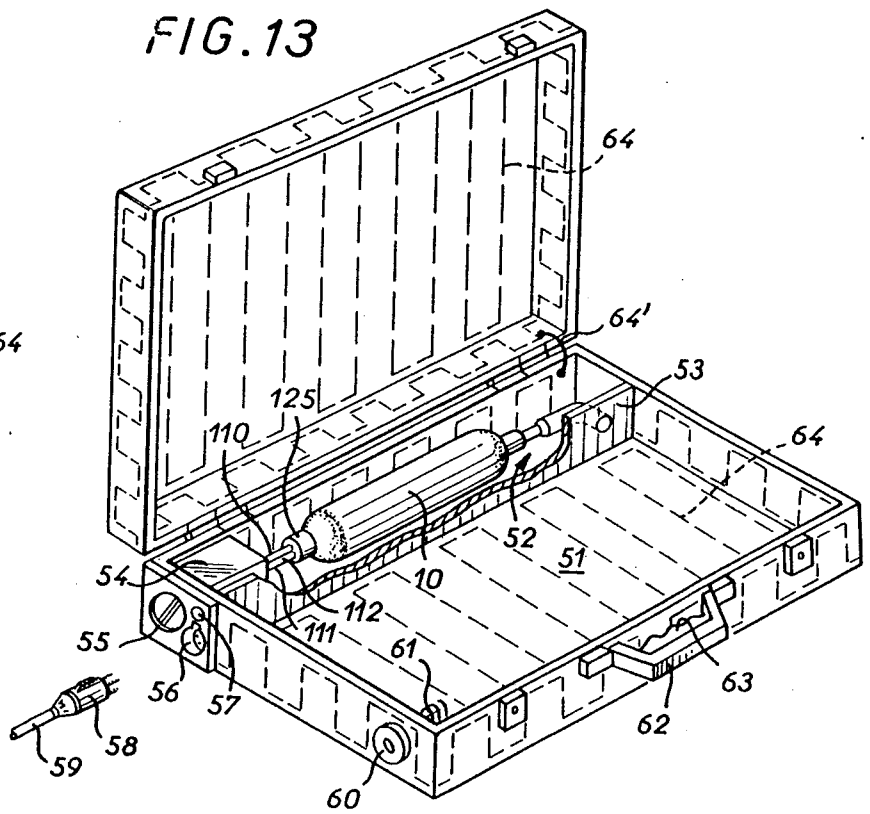
FIG. 13 is a perspective view of the attache case shown in FIG. 12, in another position.
Figure 12:
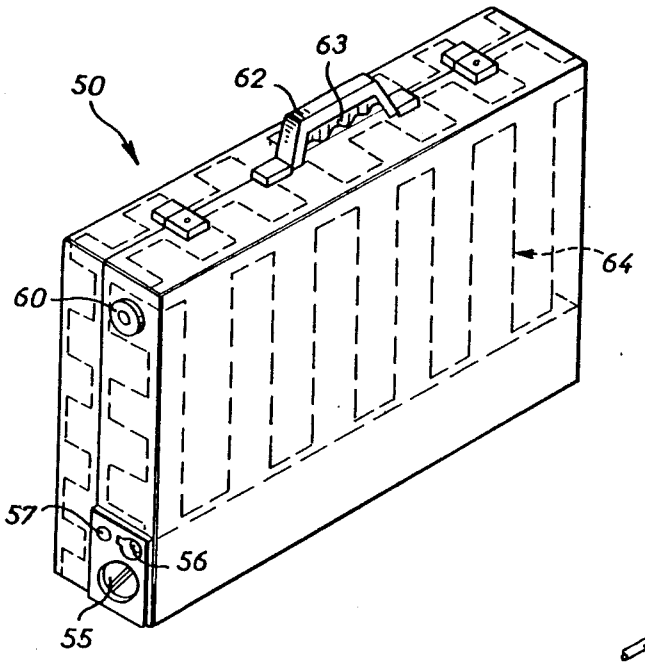
FIG. 12 is an overall perspective view of a first embodiment of a security device according to the invention in the form of an attache case.

FIGS. 12 and 13 show a first embodiment of a security device in the form of an attache case employing the alternative embodiment of foam generator which is shown in FIGS. 1 and 4.

Such an attache case has two compartments:

A compartment 51 said to be the working compartment, adapted to receive documents or bundles of notes and separated by a partition 53 from a compartment 52 referred to as the technical unit.

The technical unit 52 contains an accumulator 10 according to the invention, of which the discharge tube is bent to a right angle and discharge into the working compartment 51, passing through the partition 53.

Apart from the accumulator 10 and its discharge tube, the technical unit likewise contains a control box 54 one face of which projects beyond the attache case, on a portion of the edging strip.

That face of the technical unit 54 which thus is visible from outside the attache case comprises a time selector switch 55, a female socket 56 for a lockable connector, and the orifice 57 of a lock.

In practice, the time selector switch 55 controls a timer 76 (shown in FIG. 23) which is inside the control box 54.

The female socket 56 is adapted to receive a corresponding male plug 58 on the end of a connecting cord 59.

The control box is connected by the three conductors 110, 111, 112 to the accumulator 10, and more precisely to the piercing member 125 thereof.

The working compartment 51 is provided with a valve 60 discharging on the outside of the attache case, and closed when at rest in fluid tight fashion by the action of a return spring 61. The valve 60 is adapted to open when the effective volume 51 or working space inside the attache case is flooded with a pressurised liquid and when this pressure exceeds a predetermined threshold.

The attache case likewise comprises a carrying handle 62 comprising a movable part referred to as the retractable handle 63 which is adapted to penetrate at least partially into the carrying handle 62 when the hand is gripped around this latter in order to carry the attache case 50.

The retractable handle 63 operates an electric contact according to its position, as will be described hereinafter. The side faces and the edging strip around the attache case comprise an interwoven thread 64 shown by broken lines in FIGS. 12 and 13.

In practice, this interwoven thread is an electric conductor of small cross-section which offers low resistance to breakage. The thread 64 is distributed evenly over the surfaces of the sides and edging strip of the attache case.

A flexible conductor 64' connects two parts of the thread 64 which are thus connected in series, each corresponding to one of the parts of the attache case. As examination of FIG. 21 will confirm, each attache case 50 comprises (not shown here) for magnetisable studs 72 disposed on the face opposite that on which the carrying handle 62 is mounted.

FIGS. 14 and 15 illustrate the second preferred embodiment of a security device in the form of an attache case.

Here, the attache case is of moulded aluminium alloy in order to combine lightness with rigidity. Furthermore, once the attache case has been closed, it constitutes a Faraday cage which protects the electronic components 272*a* and the electric battery 272*b* of the control box 271. The accumulator 210 is housed in a compartment 273 closed by a cover 274 fixed by four screws.

Here, the working compartment consists of a parallelepiped basket 275 which is regularly pierced ith 10 mm holes which are themselves spaced apart by 15 mm (a 10 mm grid in spaces of 15 mm). In the cover of the attache case, on the inside, a plate 276 pierced in the same manner and secured by screws 276*a* constitutes the sixth face of the parallelepiped, by closing the lid of the attache case. It can likewise be seen here that the pierced walls of this parallelepiped are not in direct contact with the partitions inside the attache case but are on the contrary maintained remote therefrom by being fixed by means of spacing nipples 277 which are themselves fixed by screws to the partitions of the attache case. Here, the conductive thread 64 within the attache case shown in FIGS. 12 and 13 has been replaced by an alternately thin plastic/thin metal multi-layer screen 278 which will be described in detail hereinafter.

This screen has been glued to the inside of the bare attache case which, when closed, defines by its inner walls a straight parallelepiped which, as it opens, bounds a first portion of a parallelepiped referred to as the lid and a second which is referred to as the empty receptacle.

This screen must be disposed very precisely so that the prefabricated holes clearly correspond with the screws inside the case and with the passages for connections between the outside and inside of the attache case. The corresponding metal layers of the screen in the lid and those in the empty receptacle are connected by a flexible cable 279 which is of sufficient length to allow the lid to move.

Here, the attache case is provided with the preferred foam generator which is shown in FIG. 5. It comprises closure means 280 intended to be key operated, which constitute one of the devices for triggering the foam generator. This attache case is likewise provided with a retractable handle 281 with an electric contact and with a control box 282 on the left, on the front surrounding strip.

This control box comprises, a shown in FIG. 15*b*, an inlet for an activating/deactivating key 283, a light emitting diode or LED 284, a female DIN audio socket with five contacts, 285, a knob 286 for regulating the timer and a push-button 287.

Inside the control box 271 there is a limit switch 288 adapted to be operated by having applied to it a nipple 289 of adjustable height fixed on the inside of the lid of the attache case and which fits into the hole 290 in the lid of the said control box.

This attache case likewise comprises four magnetisable studs 291 on the rear outside face of the receptacle.

FIG. 16 shows in a section taken on the line XVI—XVI through the wall of the lid of the attache case shown in FIG. 14. Glued to the aluminium alloy wall 292 is the preassembled screen 278, which is achieved by glueing on alternate layers of thin sheets 293 (each sheet 25 μm thick) of polypropylene and thin sheets 294 of aluminium (each sheet 15 μm thick). The lining has a thickness in excess of $(25\ \mu m \times 5)+(15\ \mu m \times 4)=185\ \mu m$ on account of the layers being glued together.

FIG. 17 shows in a cross-section taken on the line XVII—XVII the edge of an opening in such a screen shown in FIG. 14. To ensure electrical insulation of the thin sheets 294 of aluminium, the thin sheets 293 of polypropylene, in the vicinity of a hole or of an end of the screen extend beyond the dimensions of the aluminium sheets and are glued to one another, polypropylene to polypropylene, and stop at approximately the edge of the hole 294 which serves as a screwthreaded hole for the screw fixing a nipple 277.

FIG. 18 shows an enlarged detail of this screen in which a layer of glue 295 joints a sheet of polypropylene 293 to a sheet of aluminium 294.

FIG. 19 diagrammatically shows the electrical connection of the four insulated aluminium sheets. Starting from the wall of the attache case, the aluminium sheets are of alternating polarity and are connected to electrically conductive copper wires which are inserted between the aluminium and the polypropylene at the time of assembly.

FIG. 20 diagrammatically shows the disposition of a plurality of such attache cases which are stacked inside a transporter truck, using the magnetic studs 72. The multi-layer protective screen 278 as previously described covers all the inner walls of the truck body.

This screen is electrically connected to the control unit 331 which constitutes electronic control means for triggering flooding. A keyboard operated control box 74 is disposed in the cabin of the truck and is connected to the control unit 331 which is itself connected by male DIN plugs to all the attache cases being transported.

Figure 21:
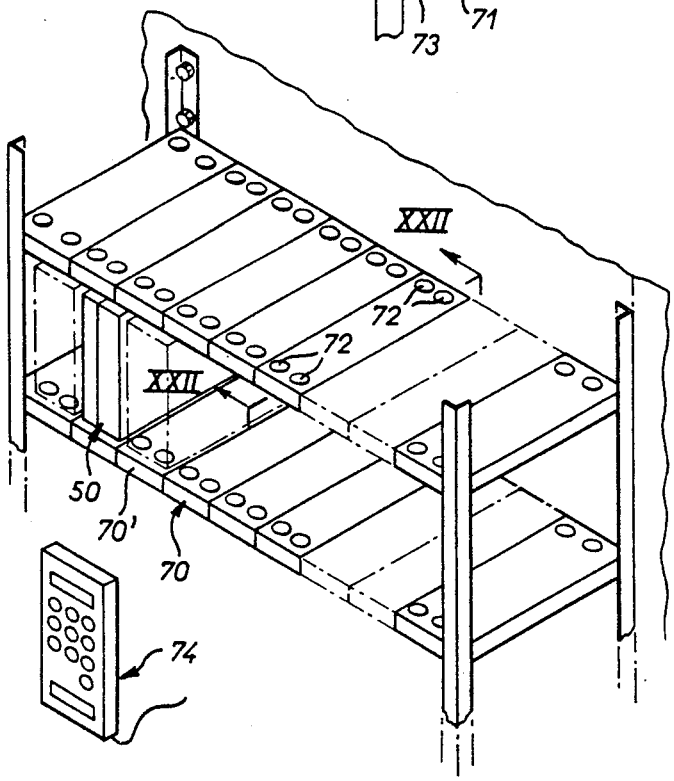

FIG. 21 generally shows a shelf in a transporter truck on which there are a plurality of attache cases and FIG. 22 partially illustrates the attache case on such a shelf.

A shelf 70 in a transporter truck comprises magnets 71 disposed in such a way as to be flush with the top face of the shelf 70, matching magnetisable studs 72 of the same cross-section, rigid with the bottom part of the edging strap around the attache case 50.

In practice, each attache case 50 comprises four magnetisable studs 72 and the shelf 70 is divided into sections 70' each of which comprises four magnets and corresponds to one attache case. The studs 72 are of a magnetisable material, mild steel for example. Each magnet 71, of the permanent magnet type, is enclosed by an electro-magnet 73, in practice a solenoid, of which the permanent magnet 71 constitutes the core. When the attache case 50 is placed on the portion 70' of the shelf corresponding to it, the cord 59 is connected as shown in FIG. 21.

A keyboard operated control box 74 disposed inside the truck is capable of making a live connection between the electro-magnets 72.

FIG. 23 shows the wiring diagram for energising one or other of the resistors 101 and 102 adapted to trigger the piercing member 125.

In practice, this circuit embodies also the flooding triggering means and their interconnection.

The truck comprises a voltage source which, through two make-and-break switches 77 and 78, supplies two conductors 77' and 78' respectively contained in the lead 59, in which a third conductor 79 is connected to earth via the connection 58/56 when this latter is engaged. The conductor 78' is connected to the conductor 111 connected to the resistor 102.

In practice, the resultant circuit is the only source of voltage for the resistor 102.

It is operated by the make-and-break switch 78 situated in the truck.

A second voltage source, in practice a battery 80, is disposed inside the control box 54 (FIG. 13).

An actuating switch 81 connects one terminal of the battery 80 to a circuit for energising the resistor 101.

The make-and-break switch 81 may be opened by a key 82 corresponding to the lock 57, and is closed by the locking device (symbolised by an arrow drawn by a broken line) of the connector 56 when the plug 58 is connected.

However, the opening and closing of the make-and-break switch 81 may be differently envisaged in other forms of embodiment of the invention.

The means of closing the make-and-break switch 81 constitute the actuating means of the detector means as will become apparent hereinafter.

Downstream of the make-and-break switch 81, the circuit for energising the resistor 101 is sub-divided into two circuits which join again downstream of the point 99, feeding the conductor 110.

A first so-called internal circuit can alone be supplied by the battery 80.

It comprises two branches.

A first branch comprises, in parallel inter se, the handle 53 and the timer 76 which are in practice theft detecting means.

When at rest, the handle 63 makes contact between the two points 63', a contact which ceases to be present when the attache case is gripped by the handle.

The timer 76, regulated by the selector switch 55, becomes live, that is to say it becomes electrically conductive after a time lapse which is determined by the timer itself, with effect from its being energised.

On the downstream side, this first branch supplies voltage to a so-called intervention relay 83.

A second branch directly links the voltage source to a terminal 83' of the intervention relay 83.

The relay 83 is connected in such a way that when it is moved to the working position by being energised, it connects the terminal 84 to the terminal 83' and disconnects them when it is at rest.

The terminal 84 is on the downstream side connected to the conductor 110 via the junction point 99.

Thus, the effect of the intervention relay 83 is to energise the resistor 101.

A second circuit, referred to as the weft circuit, can be fed either by the battery 80 or by the external voltage source, the voltage being carried via the conductor 77' and via the connection 56/58.

When at rest, an inverting relay 85 links a terminal 86 connected to the battery 80 to a common terminal 88, the starting point of the weft circuit.

When called into the working position, the inverting relay 85 connects the common terminal 88 to a terminal 87 connected to the conductor 77' via the connection 56/58.

The voltage supply of the inverting relay 85 is in parallel with the terminal 87.

Thus, the make-and-break switch 77 and the connection 56/58 both operate the relay 85 which returns to its position of rest when it is no longer connected to the external voltage source which in practice will be situated inside the vehicle.

The conductor 79 serves as a return to earth for the inverting relay 85.

The weft circuit is divided into two branches:

A first branch comprises a relay referred to as the weft trigger 89.

When at rest, this relay connects the terminal 90 connected to a second branch of the circuit, which will be described hereinafter, to the point 91 connected to the junction points 99.

When called into the working position, the relay 89 connects the terminal 90 to a free terminal 92.

The relay is directly supplied with voltage by the first branch of the weft circuit and the return to earth is effected via the interwoven thread 64.

In this example of embodiment of the invention, the interwoven thread 64 is therefore disposed downstream of the supply to the weft trigger relay 89, but there would be no problem if it were to be disposed upstream, in the same branch of the circuit.

The second branch of the weft circuit comprises a timing circuit 93 between the terminal 88 and the terminal 90.

Such a circuit becomes conductive a few seconds after it has been energised, the length of time being predetermined.

Thus, when the terminal 88 receives a voltage either from the battery 80 or from the external source, the relay or triggering the weft 89 is brought into the working position and isolates the terminal 90 from the terminal 91. Only then is the terminal 90 energised when the circuit 93 becomes conductive.

The means of energising the resistor 102 is, as previously described, a means of voluntary intervention.

It can be triggered for example from the control box 74 (FIG. 22). In practice, the means capable of energising the resistor 101 will be theft detection means.

FIG. 24 shows an alternative embodiment of the first type of security device according to the invention.

All the connecting devices are pre-grouped in an electronic circuit 200 to which are connected the theft detector means, the means of actuating theft detector means, the resistors which trigger the piercing member, and the external voltage source. A casing (not shown) contains the circuit 200 and the battery 80.

Such a circuit 200 replaces the electro-mechanical device which operates relays, which is bulky, expensive and of uncertain reliability, by an entirely electronic device employing semi-conductors, which does not suffer from these drawbacks.

In this alternative embodiment, the make-and-break switches 77 and 81 are advantageously flexible blade switches disposed inside the attache case and operated by electro-magnets disposed in the shelf 70. In this case, it is possible to utilise the function of releasing the attache case from the force of attraction of the electro-magnets in order to trip connection of the weft circuit supply to the battery 80.

The interwoven thread 64, the retractable handle 63, the time selector switch 55, the resistors 101 and 102, the two flexible blade switches 77 and 81 are connected to terminals of the circuit 200 which are provided for the purpose.

The whole assembly is contained in the attache case, the voltage supply from an external source being unchangingly effected via a connection 56/58 and the lead 59.

FIG. 25 shows a fourth embodiment of a security device which employs the fourth embodiment of foam generator unit shown in FIG. 11.

This foam generator is fixed on the inside of the bag 296 by mean of screws 269*a* and 269*b* which pass through two eyelets in the bag, being locked by corresponding nuts. The igniter 221 of the foam generator is connected via an electronic box 299 and electrical connectors with two male/female plugs 322, 323 designed for rapid and easy disconnection, then an electric casing 297 fixed to a heavy belt 298. The electronic box contains its own electric power source in the form of an electric battery and also electronic means for operating the igniter 221.

FIGS. 26 and 27 show in detail the heavy belt 298.

This comprises, conceated the inside, two leather straps, a core 301 capable of conducting electric current and taking the form of two thin copper strips 302, 303. This metallic core passes through the belt between a first part 306 of a press stud situated towards one of the ends of the said belt, as far as a first eyelet 304 which is farthest removed from the fastening buckle 307. The metallic core is interrupted between two eyelets and then continues on after the second eyelet 305 until it reaches a fastener 308.

From this conductive screw nut, there runs through the inside of the belt a conductor wire 309 coated with insulator which is connected to the second complementary part 310 of the press stud, this second part being shrunk onto a slider 311 designed to slide along the belt, the sliding movement being limited by the length of the conductor wire 309.

When the belt is in the fitted and closed position, the prongs 313 of the buckle 307 engage in appropriate perforations 312 and the press stud is closed by its two matching parts 306, 310 being pressed together.

In this latter position, the two conductive eyelets 304, 305 act like the two separate ends of a concealed linear conductor which extends around the waist of the carrier.

FIG. 27 shows in section the discontinuance of the conductive core between the eyelets 304, 305 and also the fastener 308 traversing a conductive eyelet 314 connected to one of the portions of the conductive core.

The eyelets 304, 305, the big eyelet 314, the first part 306 of the press stud are electrically connected to the conductive core by spot welds. Similarly, the second part 310 of the press stud is connected to the electric wire 309 by a spot weld.

FIG. 28 shows in detail the box 297 containing the electrical circuity.

This latter has on its rear face two conductive pegs 315, 316 which fit into the two metal eyelets 304, 305 on the belt 298 and on its front face a lock 318 operated by a key 319 for actuating and de-energising the system, a push-button 325 being provided for testing the battery incorporated in the electrical box and a female connection plug 320 while the top face of the electrical box 297 is provided with an illuminated indicator 317 to show whether the unit is on or off.

The plug 320 is connected to a male plug 321 which is itself connected by an electric lead 324 to the two rapid and easy disconnect plugs 322, 323. Such disconnection can be effected by the actual weight of the bag which is provided with the foam generator. The plug 323 is connected by an electric lead 326 to the electronics box 299.

FIG. 29 shows a part of the security device in FIG. 25, which has been enclosed in a portable security unit which takes the form of a sufficiently spacious box to hold the bag 296. The electronical box 299 is connected electrically by the electric lead 326 and the plug 323 to a control box 327 which is disposed outside the box, like the control box 282 in FIG. 15*b*.

The illustration shows an aperture into which fits the actuating/de-energising key 283, an LED 284, a DIN audio plug with five contacts, 285, a knob 286 for regulating the timing mechanism and a push-button 287.

All the interior walls of this box are covered with a multi-layer protective screen such as has been previously described. This screen is electrically connected to the control box 327. This box also has a retractable handle 281 with an electrical contact fixed to the top of the cover, a closure system 328 and a limit switch 329 situated in a hole with a stud 330 of adjustable height fixed on the inside of the lid of the case and adapted to operate this make-and-break switch.

FIG. 30 diagrammatically shows an armoured van in which bags 296 and their respective foam generators are suspended in the body of the van and are electrically connected to an electric control unit 331 adapted to control impregnation of the contents of all the bags.

The body of the van is covered on all its inner faces with the previously described multi-layer protective screen. As with the attache case or the suit case, this protective screen is made in such a way as to take into account the movable interior door in the van and the various connections which have to pass through it. This screen 278 is glued to the walls of the van body. In the driver's cabin of the van there is a control box 332 connected to the control unit 331 which is adapted to trigger the foam generators by at the volition of the driver.

The way the foam generator shown in FIGS. 1, 2, 3, 4 operates has been described already. The other foam generators according to the invention operate in the same way.

The use of an attache case for transporting purposes and as shown in FIGS. 12, 13, according to the first embodiment of a security device according to the invention, will now be described particularly with reference to FIGS. 20 to 23.

When at rest, while currency is being transported in the van, each attache case 50 rests on the section 70' of shelf 70 which is allocated to it.

Direct current flows through the solenoids 73 in such a way that the electro-magnets which are thus constituted exert on the studs 72 a force which goes in the same direction as that exerted by the permanent magnets 71.

The force due to each permanent magnet is of the order of 20 kgf and is doubled by that of the electro magnet.

As each attache case comprises four studs 72, the total locking force of the attache case is therefore 160 kgf.

The plug 58 is connected to the socket 56 and supplies voltage to the weft circuit, the make-and-break switch 77 being closed.

In this condition, if an attempt is made to steal the attache case, the force to be exerted (160 kgf) to release it is such that it would cause the walls and therefore the weft circuit to be ruptured which would trigger the flooding process.

When the van has arrived at its destination, the carrier first of all makes sure that the way is clear, in conventional manner.

He then grips the attache case by the handle and adjusts the timing mechanism by means of the selector switch 55.

This isolates the internal circuit from the battery 80, until then isolated by the actuating switch 81, in the open position.

Another member of the crew, the driver of the vehicle for example, keys into the keyboard of the control box 74 a code which reverses the direction of current in the solenoids 73 corresponding to the attache case which has been taken.

This reversal of the direction of current has the effect of opposing the force of the electro magnets to those of the permanent magnets, so cancelling it out.

As the lead 59 is still connected to the attache case, the weft circuit is supplied with voltage from the van.

The carrier then disconnects the plug 58 activating the internal circuits and closing the make-and-break switch 81. Alternatively, if the switch 81 is of the flexible blade type, suppression of the magnetic force of the magnets closes it, activating the internal circuit.

Simultaneously, the switch 77 which is likewise of the flexible blade type, connected in the opposite direction, opens up, connecting the weft circuit supply to the battery 80.

The attache case is then free and all the theft detection means are simultaneously activated.

In the event of an attack, at least one of the theft detection means triggers operation of the piercing member 126 which triggers flooding with foam dye, for example. When the foam reaches a pre-determined pressure in the working space, in addition to marking the notes, it causes the sprinkler valve 60 to open.

The foam gushes out, the effect of this being to spray the dye over the immediate vicinity of the attache case and therefore over those committing the attack. This facilitates their identification should they decide to escape.

If no attack takes place, the carrier hands the attache case to the consignee, taking care not to release the handle.

The consignee holds the key which, by operating the lock 57, opens the switch 81.

Therefore, he deactivates all the theft detection means, isolating the battery 80.

The handle can be released and the attache case opened without triggering any flooding process.

The previously described protective screen as shown in FIGS. 16, 17, 18, 19 operates by short circuiting two layers of opposite polarity. By way of experimentation, this screen has been glued onto a sheet of iron plate 1,5 mm thick and subjected to a shot fired from a magnum revolver, the impact being shown on the iron (which simulates the wall of the van body). Depending on the energy of the projectile, the plate may be pierced or deformed to cause the screen to tear. In either case, in order to have a reliable short circuit, it would be appropriate to have four thin metal layers of alternating polarity, separated from one another and encased in five layers of polypropylene.

This screen likewise protects an enclosure which is sealed against any penetration by drills and against being cut open by a circular saw. Furthermore, the fact that there is a considerable difference in melting point between aluminium (MP=660° C.) and polypropylene (MP=165° C.), means that cutting with an oxy-acetylene torch or a laser creates a zone of contact between two layers of aluminium in the screen close to the commencement of the cut thus causing foam to invade the enclosure.

The use of the bags employed in security devices as shown in FIGS. 25, 26, 27, 28, 29 and 30 will now be described.

The carrier puts on his belt 298 which carries the electrical box 297, connects the plug to the plug 318 so making a continuous connection as far as the electronics box 299 in the sac 296 which has first been filled with bank notes.

Then, using the key 319, he activates the system while holding the bag with one hand. The luminous indicator 317 will light up. Any disconnection of the plug 318, 320, or 322, 323 by simple releasing of the bag or any cutting of the lead, or if the box is torn away or if the belt is undone will cause an opening of the electric circuit which, analysed by the electronics box 299 which is provided with a battery, will immediately produce the secondary electric current which triggers the igniter 221 producing inundation with foam so that the notes in the bag will become invalidated.

The key 319 can be taken inside the van by another carrier. If the journey takes place without attack as far as the van, the afore-mentioned device is deactivated inside the van by the key 319 and the whole security device is disconnected at the plugs 318, 320.

The plug 320 is immediately connected to the control unit 331 and the driver can, by operating the control box 332, trigger at any time an intentional flooding of the bags. Furthermore, the protective screen is activated.

An alternative form of cash transportation resides in carrying the bags 296 out of the van in the security device shown in FIG. 29 in the form of a large box.

This box is in particular fitted with a retractable handle, a timing device which cannot be differently regulated, 286, a protective screen, 278, a limit switch a closure system 328, and so produce protection similar to the previously described attache case.

Various modifications and alternatives may be contemplated by those skilled in the art without departing from the scope of the present invention. In particular it is possible to envisage substituting an electrically operated valve for a mechanical or pyrotechnic piercing member such as has been described. In particular, in the cylindrical body of a foam generator according to the invention, gas and liquid pressure spaces may be disposed on either side of a piston adapted to slide in the said cylindrical body. Furthermore, in a currency carrying situation, it is possible to envisage carrying attache cases and security boxes according to the invention, in unmarked unarmoured vehicules which would be difficult to identify by criminal elements.

What I claim is:

1. A security device for transporting documents of value such as bank notes, comprising an enclosure having a space for receiving the documents and housing a foam generating unit including a receptacle containing high wetting power marker liquid adapted to foam up and color documents, said receptacle having openable closure means, a reserve of compressed gas having means for releasing compressed gas, actuating means for controlling said means for releasing compressed gas, at least one movable wall disposed inside said receptacle between said marker liquid and said means for releasing compressed gas, a liquid/air mixing means connected downstream of said receptacle closure means for converting marker liquid into marker foam in response to compressed gas released from said reserve urging said movable wall to force liquid via said closure means to said liquid/air mixing means, and discharge means for carrying marker foam from said liquid/air mixing means to said space for marking said documents.

2. A security device according to claim 1, wherein said reserve of compressed gas comprises a bottle of compressed gas.

3. A security device according to claim 2, wherein said movable wall comprises a deformable diaphragm.

4. A security device according to claim 1, wherein said movable diaphragm comprises a rubber sac or bladder.

5. A security device according to claim 1, wherein said liquid/air mixing means comprises an injector opening into a venturi tube having gas inlet holes, said discharge means comprising a plurality of apertures.

6. A security device according to claim 5, wherein said reserve of compressed air has a closure member and said means for releasing compressed gas comprises an explosive piercing means having a piercing member adapted to perforate the closure member of said reserve of compressed gas.

7. A security device according to claim 5, wherein said discharge tube is located in a space defined by a grid member for dispensing marker foam between the outer wall of said receptacle and grid.

8. A security device according to claim 1, further comprising means for detecting unauthorized action on said enclosure adapted to provide an initiating signal to said actuating means in response to such unauthorized action.

9. A security device according to claim 8, wherein said enclosure comprises a document carrying case, said space being defined by a compartment for receiving the documents.

10. A security device according to claim 9, wherein said means for detecting unauthorized action comprises a multi-layered screen of alternating thin plastic and thin metal layers, said metal layers being connected to an electrical source, said metal layers being adapted to contact one another in response to unauthorized action.

11. A security device according to claim 10, wherein said plastic is polypropylene and metal is aluminium.

12. A security device according to claim 11, wherein said screen comprises five plastic layers about 25 μm thick and four alternating with and bonded to metal layers 15 μm thick, said metal layers being connected to electrical leads connected to said electrical source.

13. A security device according to claim 9, further comprising key-operated means for activating/deactivating said actuating means.

14. A security device according to claim 13, wherein said document carrying case comprises a retractable handle, said means for detecting unauthorized action including switch means responsive to the position of said handle.

15. A security device according to claim 13, further comprising timer means coupled to said actuating means and adapted to be activated/deactivated by said key-operated means.

16. A security device according to claim 9, wherein said document carrying case has a key-operated lock, said means for detecting unauthorized action including means responsive to the position of said key-operated lock.

17. A security device according to claim 9, wherein said document carrying case comprises a body and a lid, said means for detecting unauthorized action including a switch responsive to the opening of said lid.

18. A security device according to claim 1, wherein said enclosure is defined by a transporter van, and means for detecting unauthorized action against said van adapted to initiate said actuating means comprising a multi-layer protective screen lining the walls of said van, said screen comprising alternative thin metal and thin plastic layers, said metal layers being connected to an electrical source, said metal layers being adapted to contact one another in response to rupture of said protective screen.

19. A security device according to claim 18, wherein said van has at least one shelf for supporting document carrying cases defining self-contained security devices with foam generators and actuating means therefor.

20. A security device according to claim 19, wherein said shelf and document carrying cases comprise magnetic means for preventing unauthorized removal of said document cases from said shelf.

21. A security device according to claim 20, wherein said magnetic means comprises a combination of permanent magnets and solenoids adapted to selectively provide an attractive force adapted to oppose that of said magnetic means and add to that of said magnetic means for respectively releasing and preventing unauthorized removal of said document carrying case from the shelf.

22. A security device according to claim 21, wherein said self-contained security device cases include activating/deactivating means for the actuating means of said document carrying cases, said magnetic means being adapted to activate said activating/deactivating means in response to the application of the opposed force by said solenoids.

23. A security device according to claim 8, wherein said enclosure comprises a document carrier bag adapted to be hand carried by an authorized carrier, a detection circuit electrically connected to said actuating means and adapted to provide a signal for triggering said actuating means, said detection circuit including a normally closed electrical circuit, said electrical circuit including a disconnectable plug adapted to be disconnected in response to release of the carrier bag by the authorized carrier or in response to a force tending to pull the bag from the carrier's hand.

24. A security device according to claim 23, wherein said electrical circuit comprises a loop running along the inside of a belt adapted to be worn by the authorized carrier, said electrical circuit loop being adapted to open upon the opening of the belt.

25. A security device according to claim 23, wherein said electrical circuit loop comprises electrically conductive snap fasteners.

26. A security device according to claim 24, wherein further comprising a portable security unit adapted to receive said document carrier bag, said portable security unit having means for detecting unauthorized action on said security unit for providing a signal to said actuating means in response to such unauthorized action.

27. A security device according to claim 25, wherein said means for detecting unauthorized action comprises multi-layered protective screen lining walls of said portable security unit, said screen being adapted to provide an initiating signal in response to rupture of one of the walls of said security unit.

28. A security device according to claim 26, wherein said portable security unit includes a control box connected to the actuating means and having key-operable activating/deactivating means for the actuating means inside said carrier bag.

29. A security device according to claim 28, further comprising timer means coupled to said actuating means of said document carrier bag and adapted to be activated by said key-operated means.

30. A security device according to claim 29, wherein said portable security unit comprises a body and a lid, said means for detecting unauthorized action including a switch responsive to the opening of said lid.

31. A security device according to claim 23, wherein said carrier bag is adapted to be hung inside a transporter van and said electrical circuit is adapted to be connected to a control unit in said transporter van.

32. A security device according to claim 31, wherein the transporter van has means for detecting unauthorized action thereagainst including multi-layer protective screen with alternating thin metal and thin plastic layers, the metal layers being connected to said control unit, said metal layers being adapted to contact one another in response to rupture of said protective screen.

33. A security device according to claim 1, wherein said marker liquid comprises a surfactant and at least one dye.

34. A security device according to claim 33, wherein said marker liquid is an aqueous solution and the surfactant is an alkaline lauryl ether sulfate, the amount of surfactant being about 3% by volume of the marker liquid, the dye being selected from the group consisting of rhodamine base, tartrazine, Patent Blue V, Brilliant Blue FCF, and the amount of dye being about 0.125% to 0.3% by volume of the marker liquid.

35. A security device according to claim 33, wherein said marker liquid contains anti-freeze.

36. A security device according to claim 1, wherein said discharge means comprises a sprinkler valve adapted to spray marker foam outside said enclosure.

37. A security device according to claim 1, wherein said marker liquid is an aqueous solution comprising at least one dye and a surfactant.

38. A security device according to claim 1, wherein said marker liquid is an aqueous solution comprising at least one dye and an amount of surfactant about 3% by volume of the marker liquid.

* * * * *